United States Patent [19]

Good et al.

[11] 4,406,093

[45] Sep. 27, 1983

[54] LINER FOR EAVE MOUNTED GUTTERS

[76] Inventors: W. Travis Good, 839 SE. 32nd, Hillsboro, Oreg. 97123; Dick J. Monjay, 1818 Main St., Forest Grove, Oreg. 97116

[21] Appl. No.: 248,948

[22] Filed: Mar. 30, 1981

[51] Int. Cl.[3] ..... E04D 13/00

[52] U.S. Cl. ..... 52/11; 52/12

[58] Field of Search ..... 52/11, 12; 210/154

[56] References Cited

U.S. PATENT DOCUMENTS 2,209,741 7/1940 Sullivan et al. ..... 52/11 X

FOREIGN PATENT DOCUMENTS 267697 6/1964 Australia ..... 52/12

2547283 4/1977 Fed. Rep. of Germany ..... 52/11

*Primary Examiner*—Carl D. Friedman

*Attorney, Agent, or Firm*—James D. Givnan, Jr.

[57] ABSTRACT

A clip structure of the liner is engageable with the inwardly turned lip of a gutter. Integral with the clip structure is a pliable liner component supported by the inner wall surfaces of the gutter. The component is positionable outwardly relative the clip and gutter to permit periodic removal of debris from the gutter interior in a convenient manner. A free end of the liner is adapted for grasping to facilitate manual outward positioning of the liner.

4 Claims, 7 Drawing Figures

LINER FOR EAVE MOUNTED GUTTERS

BACKGROUND OF THE INVENTION

The present invention relates generally to gutters of the types supported by the eave of a building and more specifically to a liner which conforms generally to the shape of the gutter.

The known pertinent prior art discloses gutter attached devices which are intended to reduce the amount of debris deposited within a gutter and which devices most commonly include a section of perforate material overlying the gutter. U.S. Pat. No. 2,209,741 discloses a gutter attachment the same being held in place by a Z-shaped clip which frictionally engages the inwardly directed lip on the gutter edge.

U.S. Pat. No. 753,660 discloses a segment of rigid screen in recessed engagement with a section of gutter and located over a guitter downspout drain. Means are provided to swing the screen upwardly for discharge of collected debris.

The periodic cleaning of gutters is a bothersome task conducted at some risk which must be repeated every few months depending upon the amount of debris lodged in the gutter. Cleaning of gutters is a messy as well as risky operation since the homeowner or worker must relocate a ladder at frequent intervals along the gutter length and use some sort of cleaning tool. Washing of debris from the gutter is undesirable in that a forceful stream of water will dislodge sizeable particles of debris which ultimately come to rest in the downspout or drain line into which the downspout empties to block same.

SUMMARY OF THE PRESENT INVENTION

The present invention is embodied within a gutter liner intended for permanent securement to the gutter and includes a moveable portion which generally corresponds to the internal shape of the gutter.

The present liner includes an eave engaging portion intended for attachment to the inwardly extending gutter lip in a more or less permanent fashion. A movable segment of the liner automatically conforms, at least partially, to the gutter configuration. The movable segment is intended to be momentarily positionable externally of the gutter for the purpose of discharging collected debris. The task of elevating the movable portion may be facilitated by the same being perforate to permit the passage of water therethrough with only the debris being lifted exteriorly of the gutter. If desired, a finger grip may be provided on the movable segment for purposes of convenient gripping.

Important objects of the present invention include the provision of a liner intended for placement within a gutter which lends itself to periodic removal from the gutter to discharge various solids that may have been deposited therein; the provision of a liner for gutters which lends itself to low cost manufacture using high volume production methods; the provision of a gutter liner which may be shipped and stored in continuous rolls to facilitate merchandising of same with permitting convenient sectioning of the liner at intervals by the installer to best adapt same to a specific gutter; the provision of a gutter liner readily attachable to conventional gutters without the use of tools and without modification of the gutter.

DETAILED DESCRIPTION OF THE PREFERRED EMBODIMENTS

Figure 1:
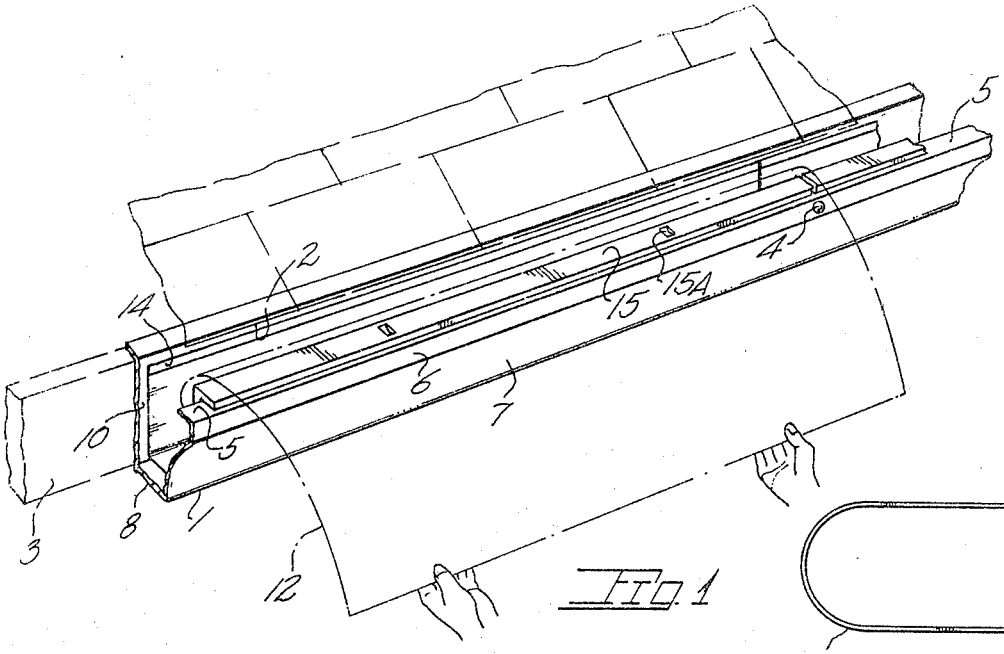
FIG. 1 is a length of a typical gutter shown in perspective and having the present liner in place therein.

With continuing reference to the drawing, applied reference numeral 1 indicates a conventional gutter of the type typically found on houses subjacent a roof edge 2. A fascia board at 3 commonly serves to support the sheet metal gutter by means of spaced apart gutter nails as at 4.

Gutters are commonly formed in a continuous fashion on roll machines and includes an inwardly directed lip 5, and outer edge 6, a front face 7, a bottom wall 8 and a back wall 10. Front face 7 may be as shown or any one of the many widely accepted gutter configurations including flat, double curved, etc. Typically inwardly directed lip 5 may be of a single thickness of metal or may be reversed to provide a lip of double thickness, either of which is compatible with use of the present liner.

The present invention is termed a liner by reason of having a positionable, elongate component 12 adapted for placement interiorly of the gutter while gutter attachment means is indicated generally at 13.

Preferably, component 12 is of a pliable nature formed from a synthetic material such as a vinyl or the like and having suitable tensile strength. Integral with one lengthwise extending extremity of component 12 is preferably a free edge portion of increased thickness as at 14 to facilitate grasping by the fingertips as later elaborated.

The remaining lengthwise extending extremity of component 12 terminates in gutter attachment means 13 including a lip supported clip structure 15. Desirably, clip structure 15 and displaceable component 12 are formed simultaneously in a high volume, low cost production operation such as by extrusion. The clip structure is adapted for gripping securement with the gutter lip and toward that end is formed with a bight 16 within which the lip is received during liner attachment. An enlarged area 16A of the bifurcated clip permits flexure of the clip web to receive the lip shown or those having a reversed double layer of sheet metal. Chamfered edges 17 at the front end of the clip facilitates placement of the clip structure over the gutter lip.

Figure 2:
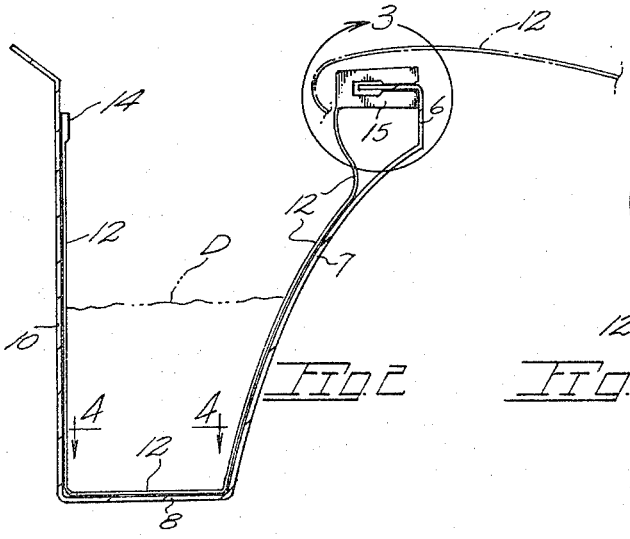
FIG. 2 is an end elevational view of the gutter with the liner in place.
Figure 3:
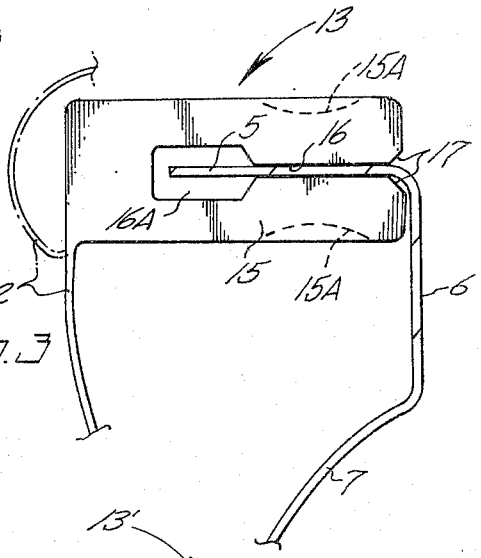
FIG. 3 is an enlarged elevational view of that portion of FIG. 2 encircled at 3.

Attachment means 13 is preferably of a lengthwise flexible nature having adequate elasticity to permit the present liner to be stored in rolls to greatly simplify both shipping and storage of same. Flexible component 12 is, as earlier noted, of a pliable nature so as to closely overlie the gutter internal wall surfaces with an inherent degree of rigidity to assure retention of the overlying relationship with gutter back wall 10. Accordingly, the liner will be disposed approximately as viewed in FIG. 2 with debris being deposited, for example, as shown in the broken line at D.

Discharge of gutter deposits entails the fingertip grasping of edge portion 14 followed by upward and outward movement of said resulting in the liner moving to the broken line position shown in FIG. 1. From the foregoing it will be seen that deposits are removed from the gutter and discharged in a convenient method followed by reinstallation of the liner.

Figure 6:
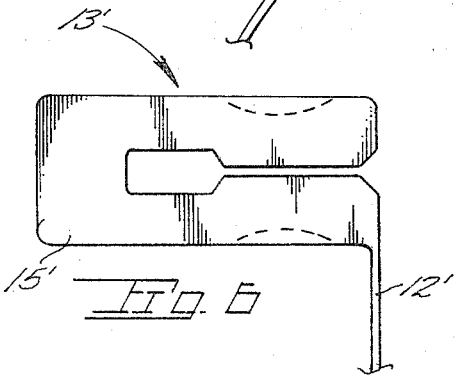
FIG. 6 is a view similar to FIG. 3 but showing a modified liner removed from the gutter.

FIG. 6 discloses a somewhat modified attachment means generally at 13' wherein liner component 12' is integral with the lower outermost extremity of clip structure 15'.

Figure 4:
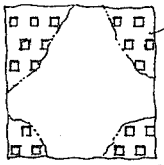
FIG. 4 is a plan view of a segment of the liner taken along line 4—4 of FIG. 2.
Figure 5:
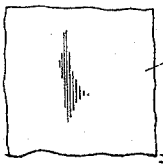
FIG. 5 is a view similar to FIG. 4 but showing a modified liner.

A liner component 12 may be a film-like elastomeric material or the like and of perforate or imperforate construction as shown in FIGS. 4 and 5. The preferred form of the invention includes a component 12 at least partially perforate with openings to permit drainage of gutter water from the liner during outward positioning of the liner for debris discharge.

Figure 7:
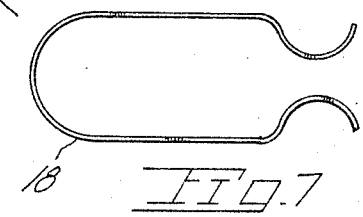
FIG. 7 is a side elevational view of a spring clip attachable to the present liner.

The liner material is such as to permit slight opening of the clip structure during lip engagement whereafter the clip structure is retained in place by a gripping action. Loads borne by component 12 of the liner are transferred to the gutter. Spring clip 18 in the side elevational view of FIG. 7 may further enhance liner securement to the gutter lip by seating within liner recesses 15A.

While we have shown but a few embodiments of the invention it will be apparent to those skilled in the art that the invention may be embodied still otherwise without departing from the spirit and scope of the invention.

Having thus described the invention, what is desired to be secured under a Letters Patent is:

I claim:

1. A liner of extruded construction for eave mounted gutters having a lip formed thereon, said liner comprising, a bifurcated clip structure adapted for biased engagement with the surfaces of the gutter lip, and a pliable liner integral with said bifurcated clip structure for supported placement within the gutter so as to overlie internal wall surfaces of the gutter, said liner having a free edge for grasping whereby said plible liner may be positioned outwardly of the gutter and inverted for discharge of gutter collected debris.

2. The liner claimed in claim 1 wherein said pliable liner is of perforate construction.

3. The liner claimed in claims 1, or 2 wherein said free edge of the pliable liner is of increased sectional dimension to facilitate grasping for periodic removal of the pliable liner from the gutter interior.

4. The liner claimed in claim 1 wherein said bifurcated clip structure defines vertically spaced recesses, clips attachable at intervals to the bifurcated clip structure within said recesses to enhance gutter lip attachment of the clip structure.

* * * * *